US006935122B2

(12) United States Patent
Huang

(10) Patent No.: US 6,935,122 B2
(45) Date of Patent: Aug. 30, 2005

(54) AIR FEEDING APPARATUS

(75) Inventor: Fu-An Huang, Ping Tung (TW)

(73) Assignee: Chiu Kuang Hsing Co., Ltd., Ping Tung (TW)

( * ) Notice: Subject to any disclaimer, the term of this patent is extended or adjusted under 35 U.S.C. 154(b) by 263 days.

(21) Appl. No.: 10/389,942

(22) Filed: Mar. 18, 2003

(65) Prior Publication Data

US 2004/0182087 A1 Sep. 23, 2004

(51) Int. Cl.[7] ..... F25B 21/02
(52) U.S. Cl. ..... 62/3.3; 62/3.4
(58) Field of Search ..... 62/3.3, 3.4, 3.2, 62/3.7, 3.5, 261, 237; 165/46; 5/423, 726

(56) References Cited

U.S. PATENT DOCUMENTS 3,886,346 A * 5/1975 Meyers ..... 219/386
4,905,475 A * 3/1990 Tuomi ..... 62/3.3
5,884,486 A * 3/1999 Hughes et al. ..... 62/3.4
6,006,524 A * 12/1999 Park ..... 62/3.7
6,223,539 B1 * 5/2001 Bell ..... 62/3.7

* cited by examiner

*Primary Examiner*—Chen Wen Jiang
(74) *Attorney, Agent, or Firm*—Rosenberg, Klein & Lee

(57) ABSTRACT

An air feeding apparatus includes an air supplying chamber disposed in a housing, and cold producing plates in the chamber, which are connected to a switching circuit controllable for changing a working mode of the plates from a cold producing one to a heat producing one. A conduit is connected to an outlet of the air supplying chamber, and sticks outside the housing. Air is forced to travel through the air supplying chamber by means of an air pump, and is guided to outside by means of the conduit; thus, the air traveling through the chamber can have temperature changed by the cold producing plates, and can be conveyed to desired locations or into other objects for use.

7 Claims, 3 Drawing Sheets

AIR FEEDING APPARATUS

BACKGROUND OF THE INVENTION

1. Field of the Invention

The present invention relates to an air feeding apparatus, more particularly one, which can be controlled to change temperature of air supplied from it according to needs.

2. Brief Description of the Prior Art

In early time when air conditioners were not available, electric fans were used to increase ventilation to reduce high temperature in the summer, and stoves were used to produce heat in the winter. Nowadays, air conditioners and electric heating devices are easily available, and many large buildings are equipped with central air conditioning systems therefore people live in a more comfortable environment from the point of view of temperature control.

However, performance of electric fans is significantly reduced in hot weather. And, air conditioners are relatively expensive, and cannot be carried. In addition, central air conditioning systems are only suitable for large buildings such as hospitals and commercial centers.

SUMMARY OF THE INVENTION

It is a main object of the present invention to provide an air feeding apparatus, which can be controlled to change temperature of air supplied from it according to needs, and which can pump the air to any desired locations with a pipe so that it has functions different from those of conventional air conditioners.

It is another object of the present invention to provide an air feeding apparatus, which includes cold producing plates disposed in a chamber, which are connected to a switching circuit controllable for changing a working mode of the plates from a cold producing one to a heat producing one; thus, the present apparatus can provide cool in summer and warmth in winter.

It is yet another object of the present invention to provide additional heating device such as ceramic heating tube to the present air feeding apparatus so that the heating effect can be stronger.

It is still another object of the present invention to provide an air feeding apparatus, which has a conduit connected to an outlet thereof so that air can be conveyed to any desired locations or other objects, e.g. an inflatable mattress, according to needs, and which consumes less power than conventional air conditioners, and is compact, and light in weight to be easily carried.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
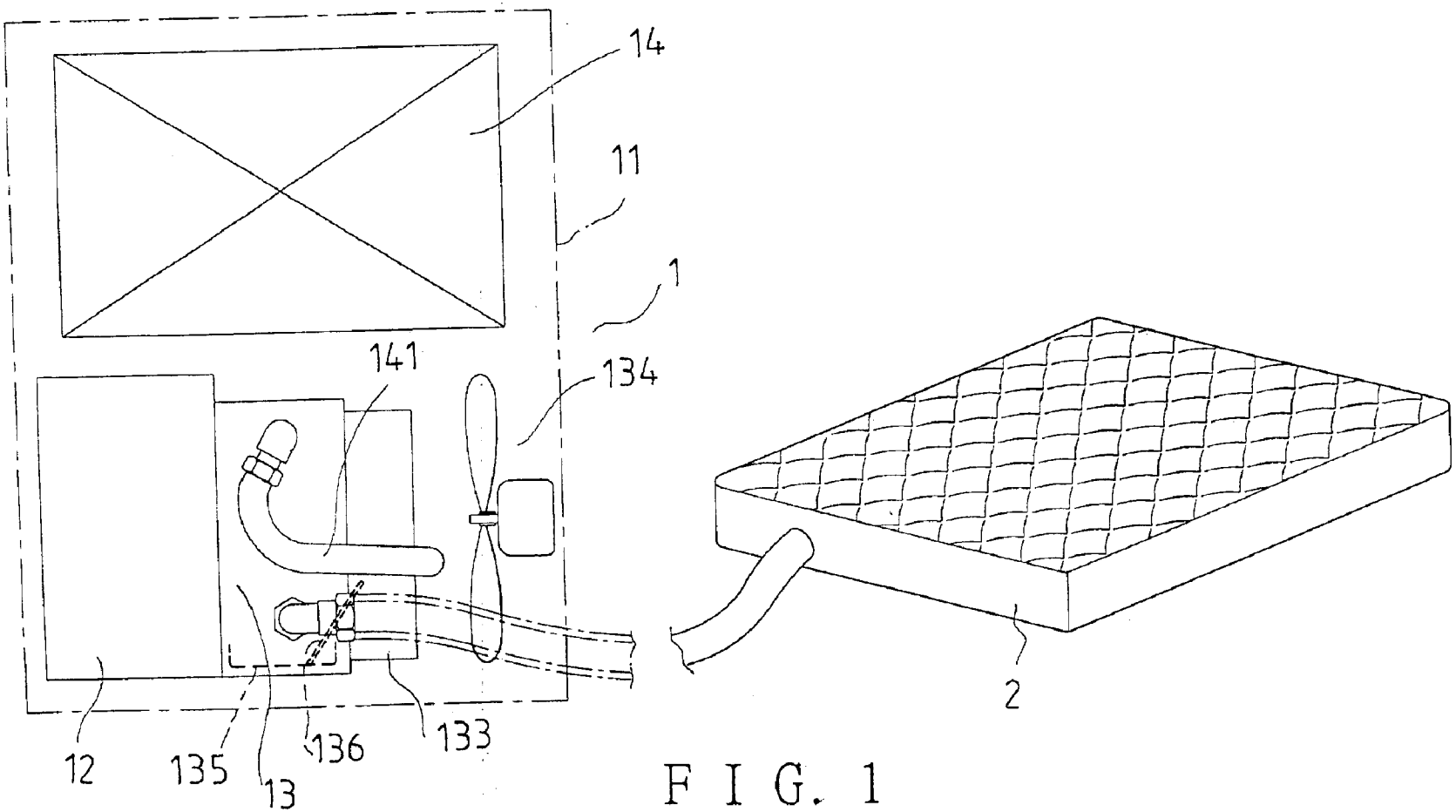
FIG. 1 is a side view of the air feeding apparatus according to the present invention.
Figure 2:
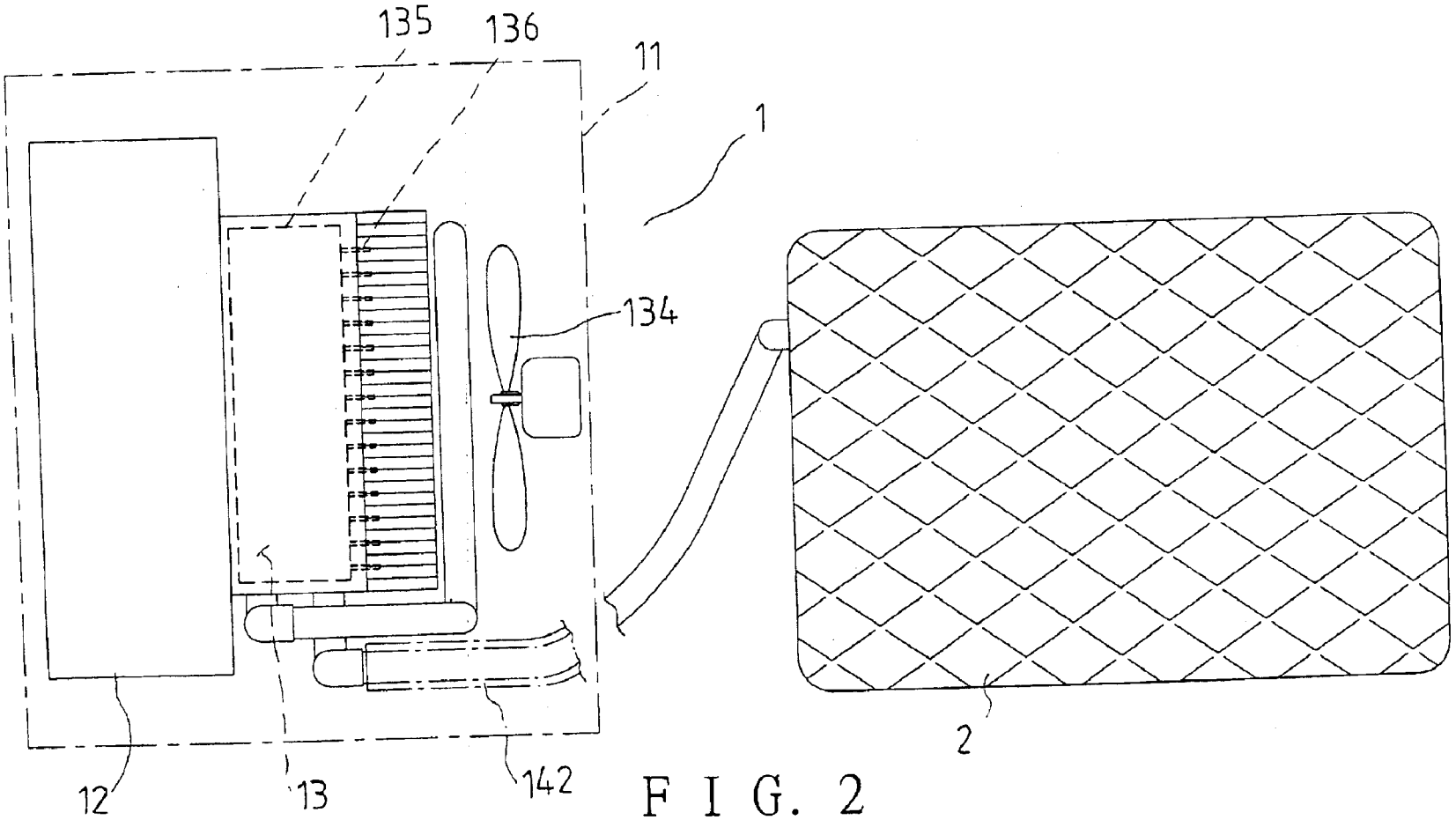
FIG. 2 is a bottom view of the air feeding apparatus according to the present invention; and, FIG. 3 is a circuit diagram of the air feeding apparatus according to the present invention.
Figure 3:
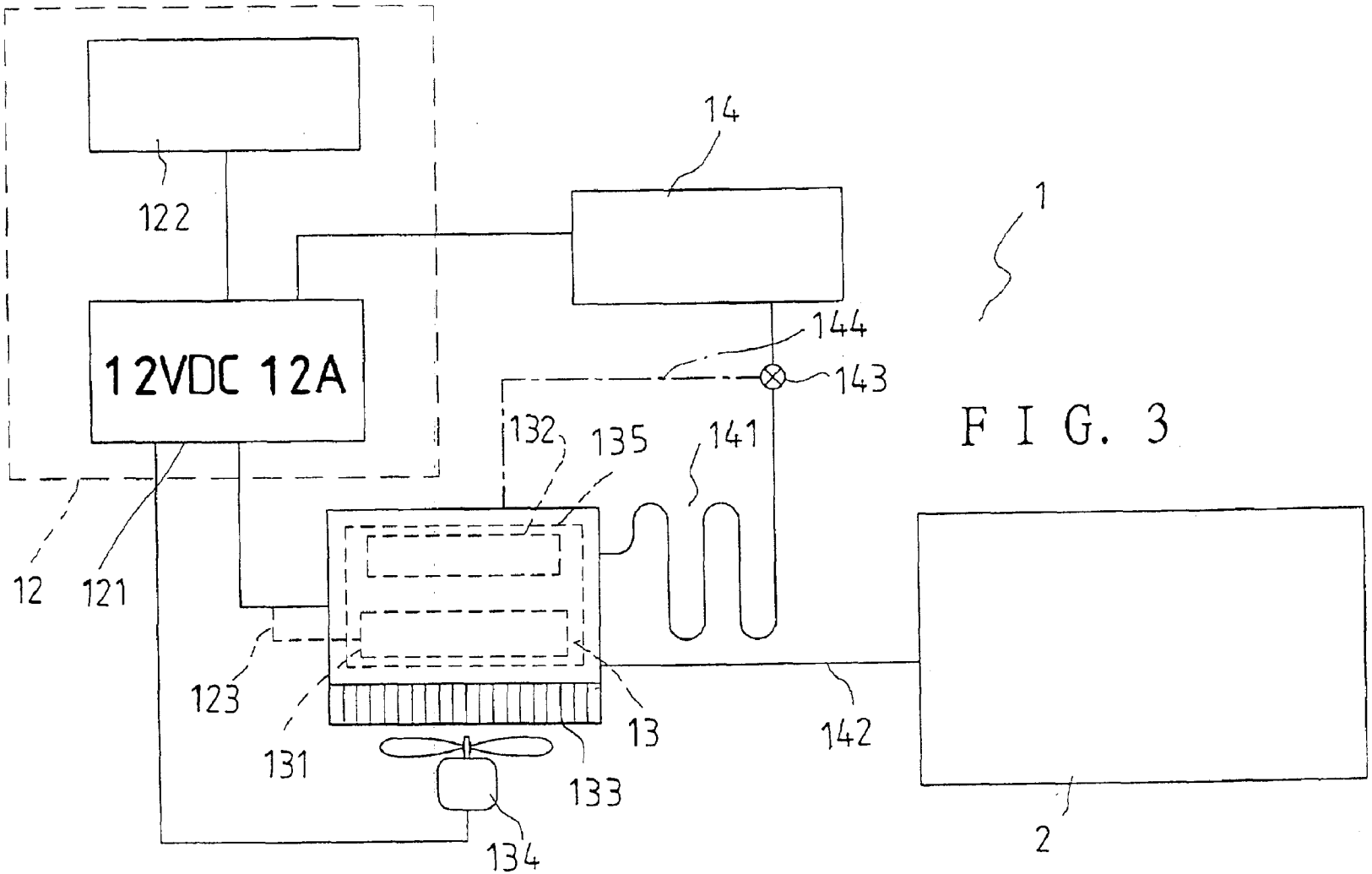

Referring to FIGS. 1, 2, and 3, a preferred embodiment 1 of an air feeding apparatus in the present invention includes a main housing 11, a control box 12, air supplying chamber 13, and an air pump 14 as main parts.

A power supplier 121 is disposed in the housing 12, and has a switch 122 for controlling on and off of power. The switch 122 can be of a manual control type or a remote control type used together with a remote control (not shown).

A cold producing plate 131 as well as a ceramic heating tube 132 are disposed in the air supplying chamber 13 while heat dissipating fins 133 and an electric cooling fan 134 are disposed outside the air supplying chamber 13. A water collecting dish 135 is disposed under the cold producing plates 131 for collecting condensed water formed on the plate 131. Capillaries 136 are provided for conveying water collected in the dish 135 to the heat dissipating fins 133. And, the cooling fan 134 can work to move cool air onto the heat dissipating fins 133 to help dissipate heat and condensed water on the fins 133.

The air pump 14 provides compressed air, and is connected to the air supplying chamber 13 at an outlet thereof while a conduit 142 is connected to an outlet of the air supplying chamber 13, and sticks out of the housing 11. Thus, cold or heat in the air supplying chamber 13 can be conveyed outside the housing 11 via the conduit 142 for use by means of air of the air pump 14. An outlet of the conduit 142 can be connected to an inflatable mattress 2, a respirator or a small room according to needs. Because air from the present apparatus has been changed to desirable temperature, when an inflatable mattress is inflated with air from the present apparatus, the air will provide suitable temperature to the users of the mattress.

A valve 143 is provided, which can be switched to a first position for connecting the outlet of the air pump 14 to a first long pipe 141 wound to pass in front of the fan 134 several times; thus, when the present air feeding apparatus is used to supply cold, heat can be greatly dissipated by the fan 134, which is produced by the air pump 14 and carried by air from the pump 14. The valve 143 can be switched to a second position for connecting the outlet of the air pump 14 to a second short pipe 144 arranged so as not to face the fan 134; thus, when the present air feeding apparatus is used to supply warm air, heat won't be dissipated by the fan 134, which is produced by the air pump 14 and carried by air from the pump 14, and in turns, the warm air can be provided with still higher temperature.

To use the air feeding apparatus for supplying cold, the switch 122 is moved to on position to actuate the power supplier 121, a switching circuit 123 made to be in a cool-producing mode, and the cold producing plate 131 are made to produce cold with Hall effect. Heat is dissipated by means of the fins 133 and the fan 134. And, the air pump 14 works to move air through the air supplying chamber 13, and in turns, cool air is conveyed outside for use via the conduit 142. To increase cooling effect of the apparatus, the valve 143 is preferably switched to the first position so that the outlet of the air pump 14 is connected to the first long pipe 141 for allowing heat to be dissipated, which is produced by the air pump 14 and carried by air from the pump 14. To use the air feeding apparatus for supplying heat, positive and negative terminals of the cold producing plate 131 are first made to be in reverse direction by means of the switching circuit 123 such that the cold producing plate 131 are made to produce heat instead of cold. If the cold producing plate 131 alone can't supply sufficient heat, the ceramic heating tubes 132 are used to provide more heat, and the valve 143 is moved to the second position for connecting the outlet of the air pump 14 to the second short pipe 144.

Furthermore, additional cold producing plate 131 can be disposed in the chamber 13, and connected to each other to enhance performance of the present apparatus.

From the above description, it can be easily understood that the air feeding apparatus of the present invention is compact, light in weight, and portable, and can help an inflatable mattress provide significantly increased comfort to the users because it can inflate the mattress with air of desirable temperature.

What is claimed is:

1. An air feeding apparatus, comprising an air supplying chamber disposed in a main housing;

an air pump disposed in the main housing for feeding compressed air into the air supplying chamber;

a power supplier disposed in a control box; the power supplier having a switch for controlling on and off of power;

the air supplying chamber having a plurality of cold producing plates therein; a switching circuit being connected to the cold producing plates for changing a working mode of same from a first cold producing one to a second heat producing one, in which positive and negative terminals of the cold producing plates are in reverse direction, a first pipe and a second pipe shorter than the first pipe being connected to an inlet of the air supplying chamber, a valve being connected to an outlet of the air pump, the valve being capable of being switched between a first position to connect the first pipe and a second position to connect the second pipe;

the air supplying chamber having a conduit connected to an outlet thereof; the conduit sticking outside the housing for guiding air to outside, which has traveled through the air supplying chamber to have temperature changed by means of the cold producing plates; and a plurality of heat dissipating fins disposed in the housing for dissipating heat produced by the cold producing plates when the cold producing plates are working to produce cold.

2. The air feeding apparatus as claimed in claim 1, wherein the switch is of a manual control type.

3. The air feeding apparatus as claimed in claim 1, wherein the switch is of a remote control type.

4. The air feeding apparatus as claimed in claim 1, wherein an electric fan is disposed in the housing for helping the heat dissipating fins to dissipate heat.

5. The air feeding apparatus as claimed in claim 1, wherein a ceramic heating tube is disposed in the air supplying chamber for assisting with heat producing when the cold producing plates are used to produce heat in the second mode.

6. The air feeding apparatus as claimed in claim 1, wherein a water collecting dish is disposed under the cold producing plates for collecting condensed water formed on the plates, and a plurality of capillaries are provided for conveying water collected in the dish to the heat dissipating fins.

7. The air feeding apparatus as claimed in claim 1, wherein the valve is switched to the second position when the air supplying plates are working to produced heat in the second mode so that air from the air pump can travel through the second pipe for preventing heat in the air from being dissipated on a course of the air being conveyed from the pump to the chamber.

* * * * *